US007798848B2

(12) United States Patent
Islam

(10) Patent No.: US 7,798,848 B2
(45) Date of Patent: Sep. 21, 2010

(54) INNER CONTACT SUPPORTING AND BIASING INSULATOR

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/362,070

(22) Filed: Jan. 29, 2009

(65) Prior Publication Data

US 2010/0190378 A1 Jul. 29, 2010

(51) Int. Cl.
*H01R 9/05* (2006.01)

(52) U.S. Cl. ..... 439/578; 439/585

(58) Field of Classification Search ..... 439/578, 439/583–585

See application file for complete search history.

(56) References Cited

U.S. PATENT DOCUMENTS

| | | | | |
|---|---|---|---|---|
| 3,671,926 | A | 6/1972 | Nepovim | |
| 3,757,279 | A | 9/1973 | Winston | |
| 3,761,870 | A | 9/1973 | Drezin et al. | |
| 3,847,463 | A | 11/1974 | Hayward et al. | |
| 4,491,685 | A | 1/1985 | Drew et al. | |
| 4,676,577 | A | 6/1987 | Szegda | |
| 4,923,412 | A | 5/1990 | Morris | |
| 5,154,636 | A * | 10/1992 | Vaccaro et al. | 439/583 |
| 5,352,134 | A | 10/1994 | Jacobsen et al. | |
| 6,019,636 | A | 2/2000 | Langham | |
| 6,217,384 | B1 | 4/2001 | Strasser et al. | |
| 6,607,398 | B2 * | 8/2003 | Henningsen | 439/578 |
| 6,808,415 | B1 | 10/2004 | Montena | |
| 6,955,562 | B1 * | 10/2005 | Henningsen | 439/578 |
| 7,008,264 | B2 | 3/2006 | Wild | |
| 7,011,546 | B2 | 3/2006 | Vaccaro | |
| 7,077,700 | B2 | 7/2006 | Henningsen | |
| 7,156,696 | B1 | 1/2007 | Montena | |
| 7,329,149 | B2 | 2/2008 | Montena | |
| 7,335,059 | B2 | 2/2008 | Vaccaro | |
| 7,422,477 | B2 | 9/2008 | Eriksen | |
| 7,465,190 | B2 * | 12/2008 | Henningsen | 439/578 |
| 7,488,209 | B2 * | 2/2009 | Vaccaro | 439/578 |
| 2003/0119358 | A1 | 6/2003 | Henningsen | |

(Continued)

FOREIGN PATENT DOCUMENTS

| | | |
|---|---|---|
| EP | 1701410 | 9/2006 |

OTHER PUBLICATIONS

European search report for counterpart application No. 10000519.8-2214. Issued on Jun. 2, 2010.

*Primary Examiner*—Thanh-Tam T Le
(74) *Attorney, Agent, or Firm*—Babcock IP, PLLC

(57) ABSTRACT

An insulator supporting an inner contact coaxial within a connector body bore of a connector for coaxial cable with a solid outer conductor is formed as a monolithic body with an inner contact bore extending between a connector end and a cable end. The inner contact bore is dimensioned to receive the inner contact. An outer diameter of the insulator at the connector end is configured to mate with the connector body bore of the coaxial cable connector. A plurality of spring fingers extends from the cable end of the insulator. A distal end of the spring fingers each is provided with a ramp surface, whereby during connector to cable assembly, the solid outer conductor contacts the spring fingers along the ramp surface (s), deflecting the spring fingers inward to increase inward bias upon a spring basket of the inner contact.

18 Claims, 5 Drawing Sheets

U.S. PATENT DOCUMENTS

2005/0079760 A1 4/2005 Vaccaro
2006/0040552 A1 2/2006 Henningsen
2007/0212937 A1 9/2007 Vaccaro

* cited by examiner

INNER CONTACT SUPPORTING AND BIASING INSULATOR

BACKGROUND

1. Field of the Invention

This invention relates to coaxial cable electrical connectors. More particularly, the invention relates to a monolithic inner contact support insulator for coaxial connectors, the insulator providing support and improved inner contact coupling functionality.

2. Description of Related Art

Coaxial cable connectors are used, for example, in communication systems requiring high levels of electrical performance, precision and reliability.

An insulator is used to retain and support an inner contact coaxial within a bore of the coaxial connector body. Supported by the insulator, the inner contact is subject to installation and interconnection forces as the connector is installed upon the coaxial cable end and then as the assembled connector is attached and detached from desired connection interfaces such as other coaxial connectors.

To create a secure mechanical and optimized electrical interconnection between an inner contact of the coaxial connector and an inner conductor of the coaxial cable, the cable end of the inner contact may be formed as a spring basket comprising a plurality of spring fingers biased inward to securely grasp the inner conductor. To improve the mechanical and electrical characteristics of the interconnection between the inner contact and the inner conductor, the dimensions of the spring fingers may be increased.

Alternatively, the steady state of the spring finger configuration may be configured to increase the radial inward bias characteristics of the spring fingers. Either of these configurations have the potential for unacceptably increasing the required insertion force during connector to cable interconnection and/or of introducing undesired impedance discontinuities to the coaxial connector.

U.S. Pat. No. 7,422,477 "Insulator for Coaxial Cable Connectors" by Eriksen discloses a monolithic insulator configured with a portion proximate the spring basket that collapses radially inward around the spring basket as a separate plug element applies axial compression to the cable end of the insulator during connector assembly. However, axial compression forces required to generate the radial inward collapse of the insulator element may be unacceptably high and once applied during connector assembly, may permanently deform the insulator, preventing re-use of the connector.

U.S. Pat. No. 4,923,412 "Terminal End For Coaxial Cable" by Morris discloses a three element insulator assembly for supporting the inner contact and progressively biasing the spring basket closed around the inner conductor as the rear nut is threaded onto the connector body. Corresponding wedge surfaces of the multiple insulator elements interact as the connector is assembled, generating a radial inward bias force against the spring fingers of the inner contact. However, the multiple insulator elements introduce additional manufacturing/assembly costs and complexities.

Competition in the coaxial cable connector market has focused attention on improving electrical performance and minimization of overall costs, including materials costs, training requirements for installation personnel and the total number of required assembly/installation steps.

Therefore, it is an object of the invention to provide a connector that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
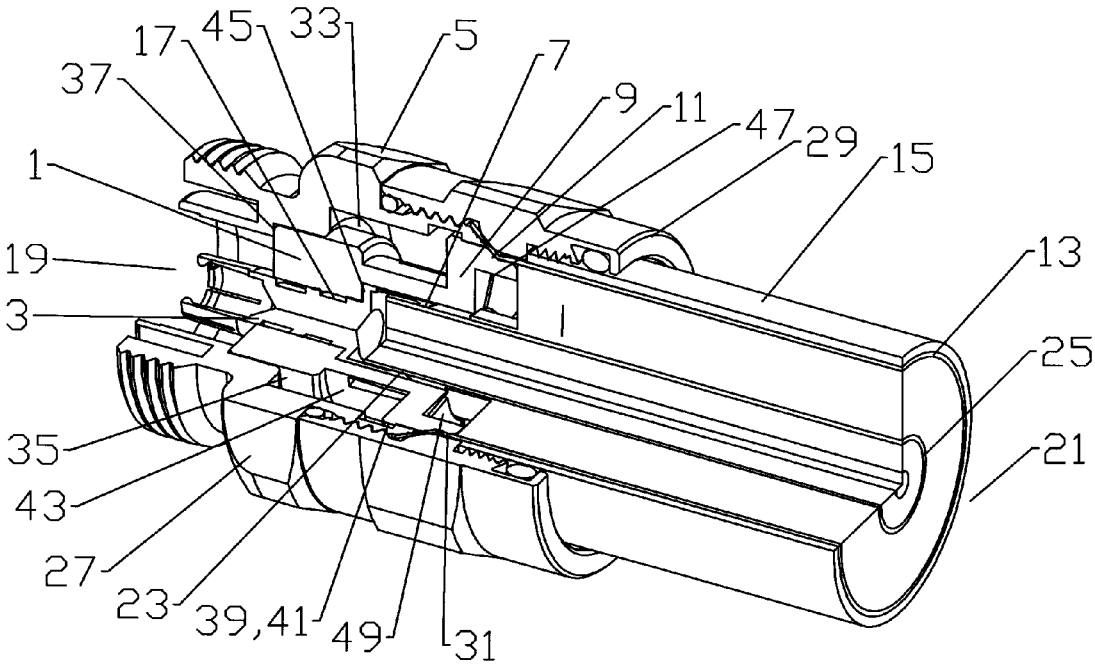
FIG. 1 is a schematic partial cut-away isometric angled view of an exemplary coaxial connector utilizing the insulator, the connector mounted upon a coaxial cable.

As shown in FIG. 1, an exemplary insulator 1 according to the invention provides a monolithic insulator 1 element that both supports the inner contact 3 within the connector 5 and provides a progressive inward bias against a spring basket 7 of the inner contact 3 via deflectable insulator spring finger(s) 9 provided with ramp surface(s) 11 contacted by the outer conductor 13 during connector 5/coaxial cable 15 interconnection.

Figure 2:
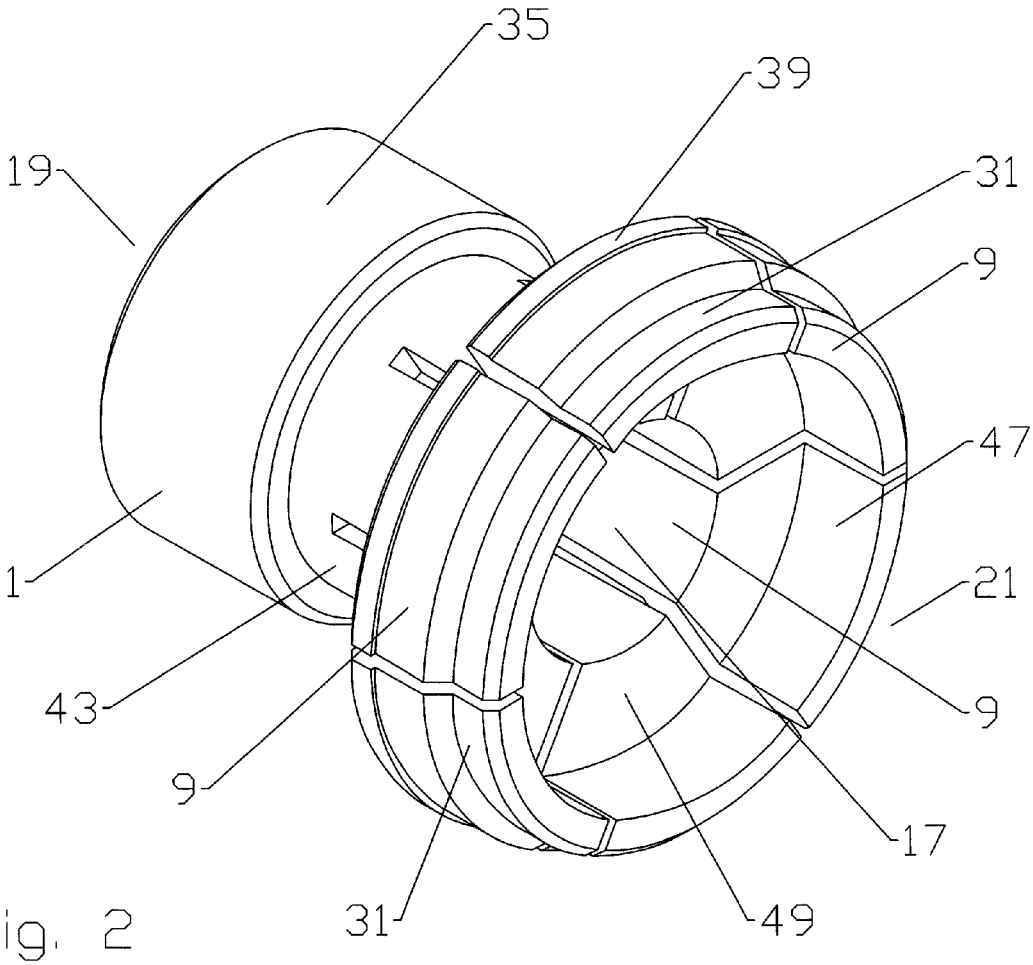
FIG. 2 is a schematic isometric view of the insulator of FIG. 1.
Figure 3:
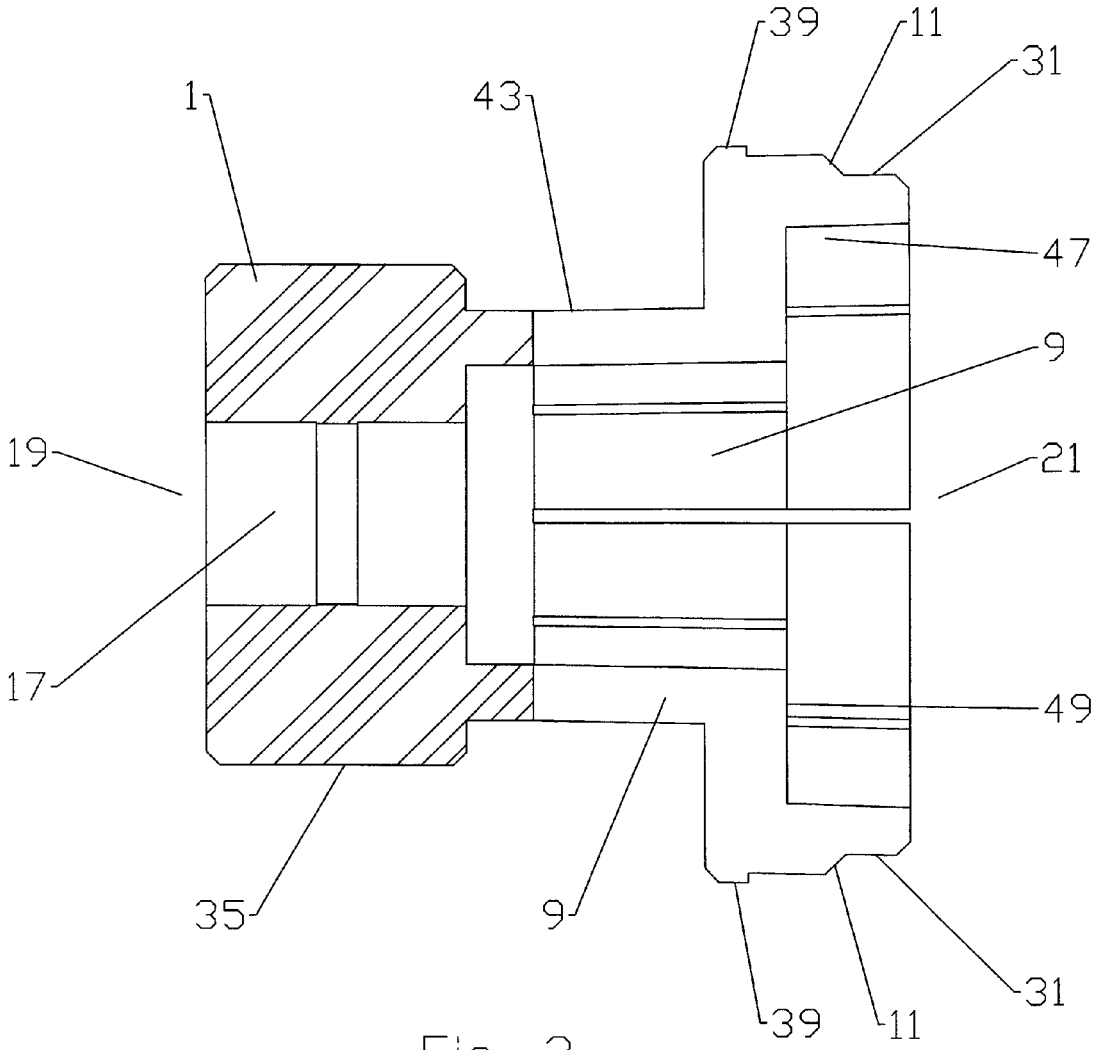
FIG. 3 is a schematic cross-section side view of FIG. 2.

As best shown in FIGS. 2 and 3, the insulator 1 may be manufactured, for example, via injection molding and/or machining, as a monolithic body of dielectric material, such as a polymer, with an inner contact bore 17 extending between a connector end 19 and a cable end 21. One skilled in the art will appreciate that the cable end 21 and the connector end 19 are descriptors used herein to clarify longitudinal locations and contacting interrelationships between the various elements of the insulator 1 and host connector 5. In addition to the identified positions in relation to adjacent elements along the insulator 1 longitudinal axis, each individual element/feature has a cable end 21 side and a connector end 19 side, i.e., the sides of the respective element/feature that are facing the respective cable end 21 and the connector end 19 of the host connector 5.

The inner contact bore 17 is dimensioned to receive the inner contact 3. The inner contact 3 is provided with a plurality of basket spring finger(s) 23, which together form the spring basket 7 at the cable end 21. The spring basket 7 is dimensioned to receive an inner conductor 25 of the coaxial cable 15.

A plurality of the insulator spring finger(s) 9 extends from the cable end 21 of the insulator 1, around the inner contact bore 17. A distal end of each insulator spring finger 9 is provided with the ramp surface 11, whereby during connector 5 to coaxial cable 15 assembly, a leading edge and/or inner diameter of the solid outer conductor 13 contacts the insulator spring finger(s) 9 along the ramp surface(s) 11, deflecting the insulator spring finger(s) 9 inward to contact the outer diameter of the spring basket 7, thereby increasing inward bias upon the basket spring fingers 23, increasing the grip and thereby the quality of the electrical interconnection between the spring basket 7 and the inner conductor 25. The ramp surface 11 may be aligned, for example, at a 45 degree angle to the longitudinal axis of the insulator 1.

To guide initial connector body 27 and coaxial cable 15/back nut 29 interconnection, an alignment surface 31 generally parallel to the insulator 1 longitudinal axis may be provided at the cable end 21 of each ramp surface 11. The plurality of alignment surface(s) 31 together form an outer diameter of the insulator 1 along the alignment surface(s) 31 that is less than an inner diameter of the solid outer conductor 13.

The insulator 1 seats within a connector body bore 33 of the host connector 5 along a mating surface 35 along the outer diameter of the insulator 1 proximate the connector end 19. The insulator 1 may be retained at the connector end 19, for example, by an insulator shoulder 37 of the connector body bore 33. To reduce the chances that the insulator 1 may be unseated by force against the connector end 19 of the connector 5, for example during connection to a further connector 5 or other connection interface, an outward extending retention tab 39 dimensioned to engage a corresponding retention groove 41 of the connector body bore 33 is located proximate a connector end 19 of each ramp surface 11. Thereby, during connector 5 manufacture, the insulator 1 may be easily inserted into the connector body bore 33 from the cable end until seated against the insulator shoulder 37, at which position the plurality of retention tab(s) 39 seat within the retention groove 41, securely longitudinally locking the insulator 1 within the connector body 27.

A primary flexure section 43 may be formed at a proximal end of each insulator spring finger 9 by reducing the outer diameter of the insulator 1 in the primary flexure section(s) 43 to, for example, less than the outer diameter of the insulator 1 proximate the connector end 19. The primary flexure section (s) 43 may be aligned longitudinally with a spring basket shoulder 45 of the inner contact bore 17 positioned proximate the connector end 19 of the primary flexure section 43. The spring basket shoulder 45 initiates an area of the inner contact bore 17 that has an increased inner diameter dimensioned to receive the spring basket 7 from the cable end 19.

Figure 4:
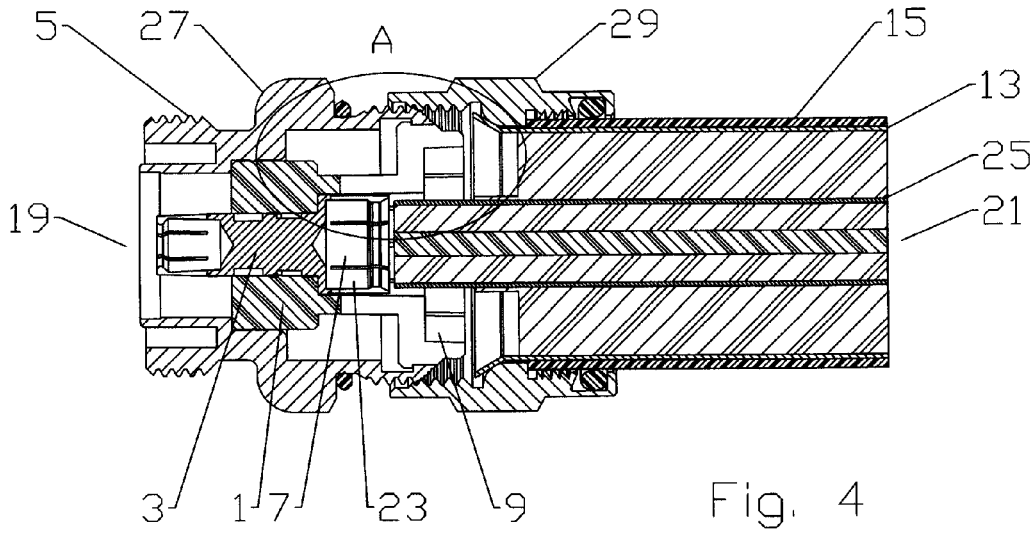
FIG. 4 is a schematic cross-section view of an exemplary coaxial connector utilizing the insulator, prepared for final interconnection with a coaxial cable.
Figure 5:
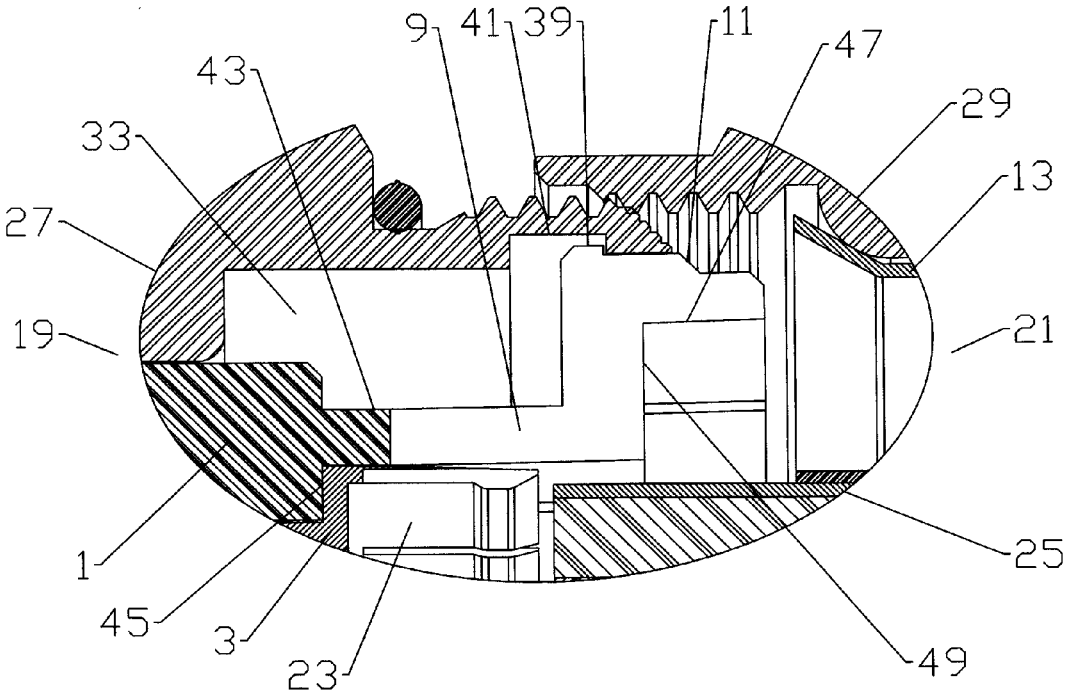
FIG. 5 is a close-up view of area A of FIG. 4.
Figure 6:
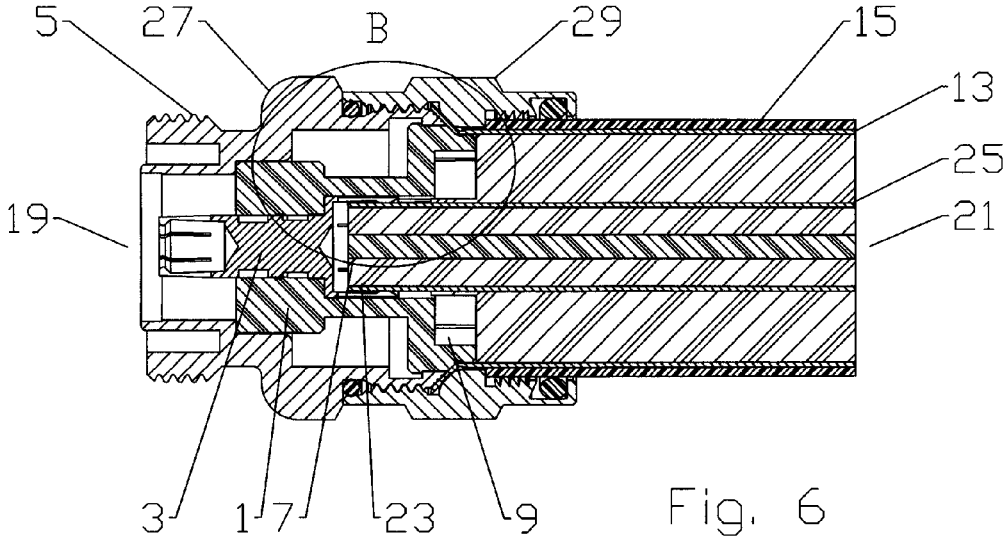
FIG. 6 is a schematic cross-section view of an exemplary coaxial connector utilizing the insulator, coupled with a coaxial cable.
Figure 7:
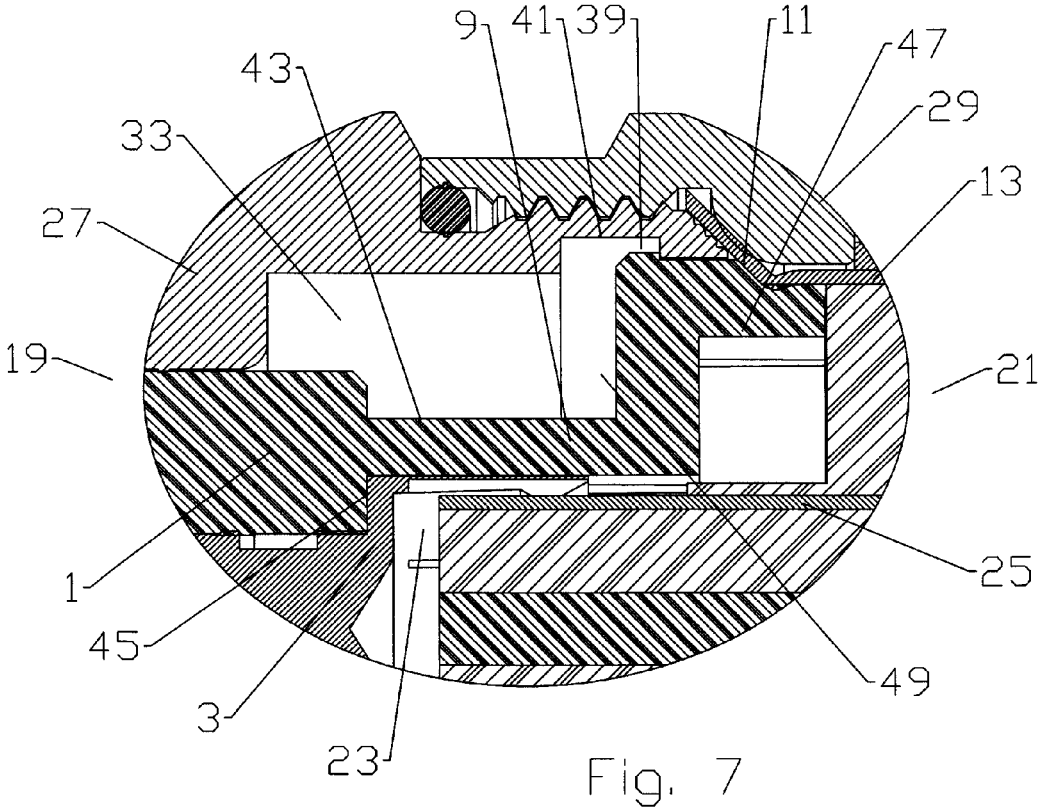
FIG. 7 is a close-up view of Area B of FIG. 6.

FIGS. 4 and 5 demonstrate the connector ready for final assembly upon the coaxial cable 15, by threading of the back nut 29 upon the connector body 27. When threading is completed, as shown in FIGS. 6 and 7, the ramp surface(s) 11 are driven inward by contact with the outer conductor 13, driving the basket spring finger(s) 23 against the inner conductor 25. Because the uniform leading edge/inner diameter of the outer conductor 13 of a coaxial cable 15 is coaxial with the inner conductor 25, as contact with the outer conductor drives the ramp surface(s) inward, the resulting bias upon the basket spring finger(s) 23 is also uniform, which improves the resulting electrical interconnections performance, for example as the interconnection is later exposed to bending and/or twisting forces.

To reduce the opportunity for the insulator spring finger(s) 9 to be deformed under long term direct compression, a secondary flexure section may be added to the cable end 21 of the insulator spring finger(s) 9 by increasing an inner diameter of the inner contact bore 17 between an extension shoulder 49 and the cable end 21 of the insulator 1. The increased inner diameter may be, for example, greater than the outer diameter of the spring basket 7, primary flexure section 43 and/or the outer diameter of the connector end 19 of the insulator 1.

One skilled in the art will appreciate that significant manufacturing and assembly efficiencies may be realized by providing the insulator 1 as a monolithic element. Further, the opportunity for mis-placement and or mis-alignment of multiple discrete connector insulator and/or drive elements during end-user installation may be eliminated.

Because the insulator spring finger(s) 9 are deflected into uniform circumferential radial compression upon the spring basket 7, instead of an axial crush force, the uniformity of the electrical interconnection may be improved along with the ease of threading of the back nut 29 during installation. Further, because a deflection rather than crush/collapse action is applied to the insulator 1, the insulator 1 is not permanently deformed, enabling re-use of the connector 5.

Table of Parts

| | |
|---|---|
| 1 | insulator |
| 3 | inner contact |
| 5 | connector |
| 7 | spring basket |
| 9 | insulator spring finger |
| 11 | ramp surface |
| 13 | outer conductor |
| 15 | coaxial cable |
| 17 | inner contact bore |
| 19 | connector end |
| 21 | cable end |
| 23 | basket spring finger |
| 25 | inner conductor |
| 27 | connector body |
| 29 | back nut |
| 31 | alignment surface |
| 33 | connector body bore |
| 35 | mating surface |
| 37 | insulator shoulder |
| 39 | retention tab |
| 41 | retention groove |
| 43 | primary flexure section |
| 45 | spring basket shoulder |
| 47 | secondary flexure section |
| 49 | extension shoulder |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. An insulator supporting an inner contact coaxial within a connector body bore of a coaxial cable connector for coaxial cable with a solid outer conductor, the insulator comprising:

a monolithic body with an inner contact bore extending between a connector end and a cable end;

the inner contact bore dimensioned to receive the inner contact;

an outer diameter of the insulator at the connector end configured to mate with the connector body bore of the coaxial cable connector;

a plurality of spring fingers extending from the cable end of the insulator;

distal ends of the spring fingers each provided with a ramp surface, whereby upon insertion into the connector body bore, the solid outer conductor contacts the spring fingers along the ramp surfaces, deflecting the spring fingers inward to increase inward bias upon a spring basket of the inner contact.

2. The insulator of claim 1, further including an alignment surface at a cable end of each ramp; the insulator having an outer diameter at the alignment surfaces less than an inner diameter of the solid outer conductor.

3. The insulator of claim 1, further including an outward extending retention tab proximate at a connector end of each ramp surface.

4. The insulator of claim 1, further including a primary flexure section at a proximal end of each spring finger; the insulator having an outer diameter at the primary flexure sections less than the outer diameter at the connector end.

5. The insulator of claim 1, wherein the inner contact bore is provided with a spring basket shoulder proximate at a connector end of the primary flexure section.

6. The insulator of claim 1, wherein an inner diameter of the inner contact bore between an extension shoulder and a cable end of the inner contact is greater than the outer diameter of a connector end of the insulator.

7. The insulator of claim 1, further including a secondary flexure section between an extension shoulder and the cable end; the secondary flexure section provided with an inner contact bore with an inner diameter that is greater than an outer diameter of the spring basket.

8. The insulator of claim 1, further including a secondary flexure section between an extension shoulder and the cable end; the secondary flexure section provided with an inner contact bore with an inner diameter that is greater than an outer diameter of a primary flexure section.

9. The insulator of claim 1, further including a secondary flexure section between an extension shoulder and the cable end; the secondary flexure section provided with an inner contact bore with an inner diameter that is greater than an outer diameter of the connector end of the insulator.

10. The insulator of claim 1, wherein the ramp surface is generally aligned at a 45 degree angle to a longitudinal axis of the insulator.

11. The insulator of claim 1, wherein the contact between the ramp surfaces and the outer conductor applies a uniform inward bias upon the spring basket.

12. An insulator supporting an inner contact coaxial within a connector body bore of a connector for coaxial cable with a solid outer conductor, the insulator comprising:

a monolithic body with an inner contact bore extending between a connector end and a cable end;

the inner contact bore dimensioned to receive the inner contact;

an outer diameter of the insulator at the connector end configured to mate with the connector body bore of the coaxial cable connector;

a plurality of spring fingers extending from the cable end; the spring fingers provided with a primary flexure section at a proximal end of each spring finger; the insulator having an outer diameter at the primary flexure sections less than the outer diameter at the connector end;

the inner contact bore provided with a spring basket shoulder proximate a connector end of the primary flexure section;

an inner diameter of the inner contact bore between an extension shoulder and a cable end of the inner contact is greater than the outer diameter of the primary flexure section;

a distal end of the spring fingers each provided with a ramp surface and an alignment surface; the insulator having an outer diameter at the alignment surfaces less than an inner diameter of the solid outer conductor, whereby during connector to cable assembly, the solid outer conductor passes over the alignment surfaces and contacts the spring fingers along the ramp surfaces, deflecting the spring fingers inward to increase inward bias upon a spring basket of the inner contact.

13. The insulator of claim 12, further including an outward extending retention tab proximate at a connector end of each ramp surface.

14. The insulator of claim 12, wherein the contact between the ramp surfaces and the outer conductor applies a uniform inward bias upon the spring basket.

15. A method for manufacturing an insulator for supporting an inner contact coaxial within a connector body bore of a connector for coaxial cable with a solid outer conductor, comprising the steps of:

forming a monolithic body with an inner contact bore extending between a connector end and a cable end;

the inner contact bore dimensioned to receive the inner contact;

an outer diameter of the insulator at the connector end configured to mate with the connector body bore of the coaxial cable connector;

a plurality of spring fingers extending from the cable end; distal ends of the spring fingers each provided with a ramp surface, whereby during connector to cable assembly, the solid outer conductor contacts the spring fingers along the ramp surfaces, deflecting the spring fingers inward to increase inward bias upon a spring basket of the inner contact.

16. The method of claim 15, wherein the monolithic body is formed by injection molding.

17. The method of claim 15, wherein the monolithic body is formed by machining.

18. The method of claim 15, wherein the monolithic body is a dielectric polymer.

* * * * *